US007090558B2

(12) United States Patent
Ott

(10) Patent No.: US 7,090,558 B2
(45) Date of Patent: Aug. 15, 2006

(54) WEIGHTED SPORTS BRA

(76) Inventor: Patrick M. Ott, 7483 Sharonlee Dr., Mentor, OH (US) 44060

( * ) Notice: Subject to any disclaimer, the term of this patent is extended or adjusted under 35 U.S.C. 154(b) by 105 days.

(21) Appl. No.: 10/686,224

(22) Filed: Oct. 15, 2003

(65) Prior Publication Data

US 2005/0085162 A1 Apr. 21, 2005

(51) Int. Cl.
*A41C 3/00* (2006.01)

(52) U.S. Cl. ..... 450/89; 450/1; 2/69; 482/105

(58) Field of Classification Search ..... 2/102, 2/113–115, 78.1–78.4, 249–251, 69, 73, 67; 482/105, 120; 450/89, 1, 54–57
See application file for complete search history.

(56) References Cited

U.S. PATENT DOCUMENTS

| | | | | |
|---|---|---|---|---|
| 4,217,905 A | | 8/1980 | Atwater et al. | |
| 4,268,917 A | * | 5/1981 | Massey | 2/102 |
| 4,382,302 A | | 5/1983 | Watson | |
| 4,394,012 A | | 7/1983 | Egbert et al. | |
| 4,407,497 A | | 10/1983 | Gracie | |
| 4,816,005 A | * | 3/1989 | Braaten | 450/58 |
| 4,989,267 A | | 2/1991 | Watson | |
| 5,144,694 A | | 9/1992 | Conrad Da oud et al. | |
| 5,496,205 A | | 3/1996 | Lee | |
| 5,553,322 A | | 9/1996 | Cebo-Johnson | |
| 5,659,898 A | | 8/1997 | Bell, Jr. | |
| 5,685,764 A | | 11/1997 | Kostritzky | |
| 5,768,706 A | | 6/1998 | Griffith et al. | |
| 5,810,699 A | | 9/1998 | Nadeau | |
| D409,697 S | | 5/1999 | Ott | |
| 5,937,441 A | | 8/1999 | Raines | |
| D425,584 S | | 5/2000 | Hines | |
| 6,081,924 A | | 7/2000 | Ott | |
| 6,110,005 A | | 8/2000 | Stephenson et al. | |
| 6,171,274 B1 | | 1/2001 | Nafpliotis | |
| 6,176,761 B1 | | 1/2001 | Underhill | |
| 6,209,135 B1 | | 4/2001 | Irvin | |
| 6,231,488 B1 | | 5/2001 | Dicker et al. | |
| 6,314,580 B1 | | 11/2001 | Greenberg et al. | |
| 6,364,851 B1 | | 4/2002 | Nafpliotis | |
| 6,517,410 B1 | * | 2/2003 | Underhill | 450/1 |
| 6,554,752 B1 | | 4/2003 | Cook | |
| 6,557,176 B1 | | 5/2003 | Franco-Sion | |
| 6,860,789 B1 | * | 3/2005 | Bell et al. | 450/20 |

* cited by examiner

*Primary Examiner*—Gloria M. Hale
(74) *Attorney, Agent, or Firm*—Tarolli, Sundheim, Covell & Tummino LLP

(57) ABSTRACT

A bra to be worn by a woman during exercising includes front and rear portions. A plurality of pockets are disposed in the front and rear portions of the bra. A plurality of weights may be disposed in the pockets. Any one of the weights may be connected in any one of a plurality of locations relative to the bra.

25 Claims, 3 Drawing Sheets

WEIGHTED SPORTS BRA

BACKGROUND OF THE INVENTION

The present invention relates to a bra which is worn by a woman during exercise and has one or more weights to provide resistance which must be overcome during exercise.

It has previously been suggested that weights may be secured to a vest and worn during various types of exercise, for example, during aerobic exercises, running, or the playing of sports. The weighted vest may include weights which are held in pockets. One known weighted vest is disclosed in U.S. Pat. No. 6,081,924. Generally speaking, known weighted vests are designed to be worn by men.

SUMMARY OF THE INVENTION

The present invention relates to a new and improved bra which is to be worn by a woman during exercise, such as the playing of games, aerobic exercises, or jogging. The bra includes a front portion which is designed to provide support for the woman's breasts during exercise. The bra also includes a rear portion which is designed to extend across the woman's back.

One or more pockets may be formed in the front and/or rear portion of the bra. One or more weights may be disposed in the pocket or pockets to provide resistance which must be overcome by the woman during exercise.

A releasable fastener may be utilized to connect the weight or weights with the bra. The fastener may include a first portion which is connected with the weight or weights and a second portion which is disposed in the pocket in the bra. The first and second fastener portions are engageable to connect a weight in the pocket with the bra. A weight or weights may-be connected with the bra at any one of a plurality of locations in the pocket or pockets. Fastener portions may be provided to connect the weights with each other.

It should be understood that the present invention provides a plurality of different features. These features may be utilized together in the manner disclosed herein. Alternatively, the features may be utilized separately or in combination with features from the prior art. It should be understood that the invention is not to be limited to the specific embodiment of the invention described herein.

BRIEF DESCRIPTION OF THE DRAWINGS

The foregoing and other features of the invention will become more apparent upon consideration of the following description taken in connection with the accompanying drawings wherein.

DESCRIPTION OF ONE SPECIFIC PREFERRED EMBODIMENT OF THE INVENTION

Figure 1:
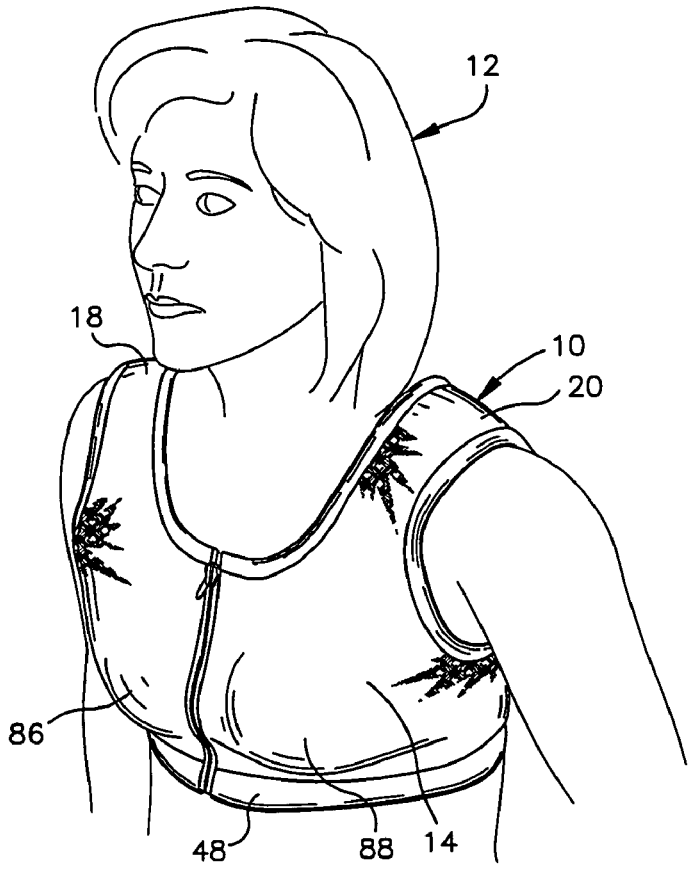
FIG. 1. is a schematic pictorial illustration depicting the wearing of a bra constructed in accordance with the present invention by a woman.
Figure 2:
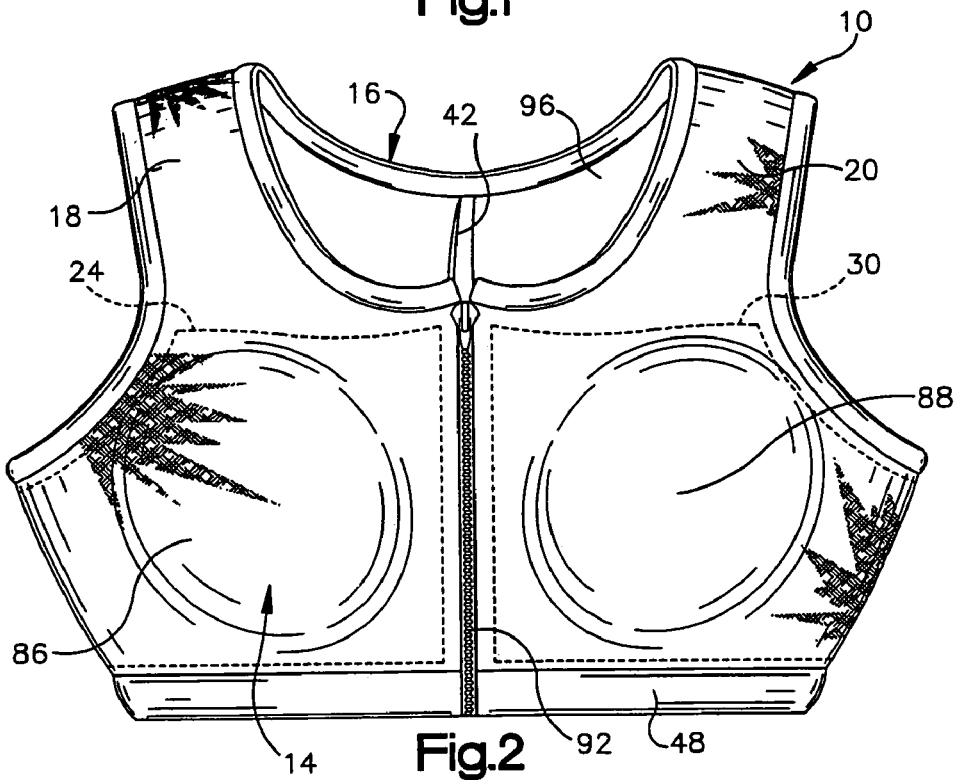
FIG. 2. is a schematic front plan view of the bra worn by the woman in FIG. 1.

An improved weighted sports bra 10 (FIG. 1) is worn by a woman 12 during exercise. The sports bra 10 includes a front portion 14 which is designed to provide support for the breasts of the woman 12 during exercise. A rear portion 16 (FIGS. 2 and 3) is connected with the front portion 14 and is designed to extend across the back of the woman 12. A pair of strap portions 18 and 20 are designed to extend across the shoulders of the woman 12. The sports bra 10 may be worn by the woman 12 during exercising. For example, the sports bra 10 may be worn during body movement which may occur when participating in sports or during body movement which may occur during repetitive exercises to develop and/or maintain physical fitness.

Figure 3:
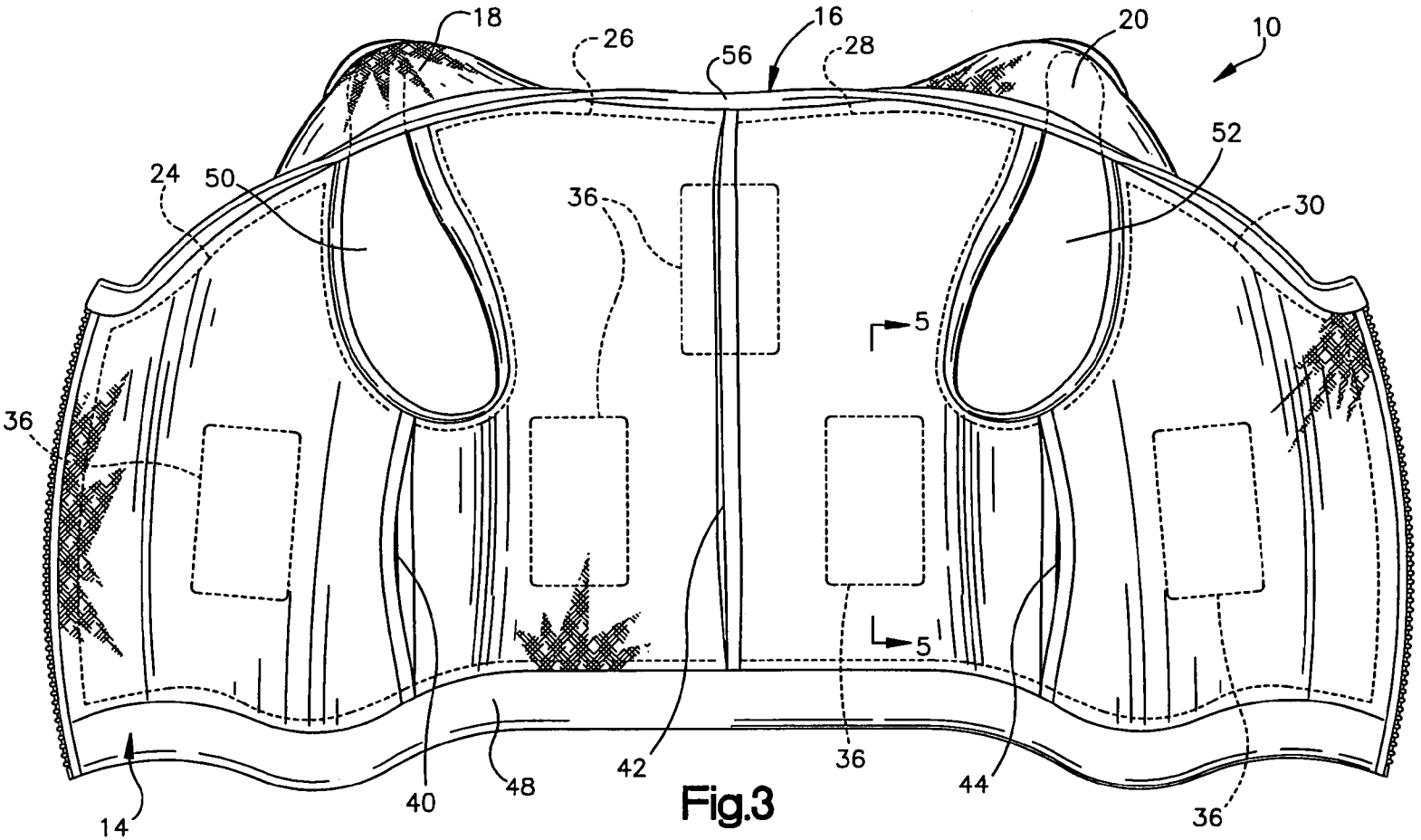
FIG. 3. is a schematic inside plan view of the bra of FIG. 2 in an open or laid out condition.

In accordance with a feature of the present invention, the sports bra 10 is provided with a plurality of pockets 24, 26, 28, and 30 (FIG. 3). The pockets 24 and 30 are disposed in the front portion of the sports bra 10. The pockets 26 and 28 are disposed in the rear portion 16 of the sports bra.

In the illustrated embodiment of the sports bra 10, the pockets 24, 26, 28 and 30 are formed as one continuous pocket and which extends around the woman 12. Thus, the pockets 24 and 30 in the front portion 14 are formed as continuations of the pockets 26 and 28 in the rear portion 16. Similarly, the pocket 26 is a continuation of the pocket 28. However, it should be understood that one or more of the pockets 24–30 may be separate from the other pockets. Thus, seams may be sewn into the sports bra 10 to separate the front pockets 24 and 30 from the rear pockets 26 and 28. If desired, seams could be provided in the rear pockets 26 and 28 to separate them from each other.

One or more weights 36 (FIG. 3) may be provided in the pockets 24–30. In FIG. 3, weights 36 have been illustrated in dashed lines as being disposed in each of the pockets 24–30. However, a single weight may be provided in one of the pockets and the other pockets may be empty. Alternatively, a plurality of weights 36 may be provided in some of the pockets while the other pockets contain a single weight or are empty.

For example, a weight 36 may be disposed in each of the rear pockets 26 and 28 and a third weight may be positioned at the intersection between the rear two pockets, in the manner illustrated in FIG. 3. The front pockets 24 and 30 may be empty so that weights 36 are disposed only the rear pockets 26 and 28. Alternatively, weights 36 may be provided in just the front pockets 24 and 30. Of course, weights may be provided in all four pockets in the manner illustrated in FIG. 3. Although five weights 36 have been illustrated in FIG. 3 as being disposed in the pockets 24–30, a greater or lesser number of weights may be provided in the pockets.

The weights 36 are inserted into and removed from the pockets 24–30 through openings 40, 42 and 44 (FIG. 3). The openings 40 and 44 are formed as slits which extend between a band 48 at a lower edge portion of the sports bra 10 and arm openings 50 and 52. The opening 40 provides access to the front pocket 24 and the rear pocket 26. Similarly, the opening 44 provides access to the front pocket 30 and the rear pocket 28.

The opening 42 is formed as a slit which extends from the band 48 to an upper edge portion 56 of the rear portion 16 of the sports bra 10. The openings or slits 40, 42, and 44 are left open. However, if desired, fasteners may be provided to close the openings 40–44 once the weights 36 have been inserted into the pockets 24–30.

The weights 36 provide resistance which must be overcome by the woman 12 during exercise. The weights may be of different magnitudes and different sizes. However, it is believed that the weights 36 should have a magnitude of at least four ounces or more. Although the weights 36 have been illustrated in FIG. 3 as having a generally rectangular configuration, it is contemplated that the weights 36 may have a different configuration, such as a circular configuration. If desired, the weights 36 may be formed as sheets having configurations conforming to configurations of portions of the pockets 24–30.

Figure 4:
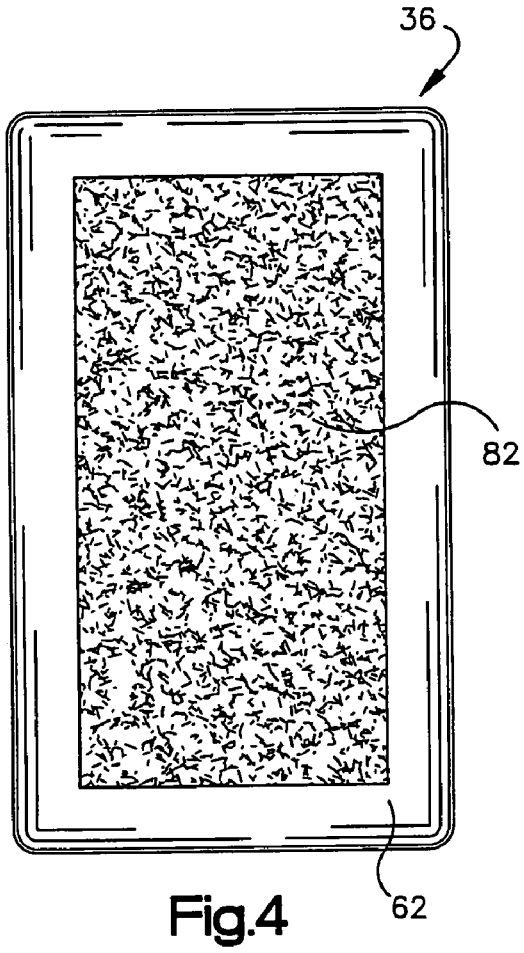
FIG. 4. is a plan view of a weight which may be disposed in a pocket in the bra of FIGS. 1–3.
Figure 5:
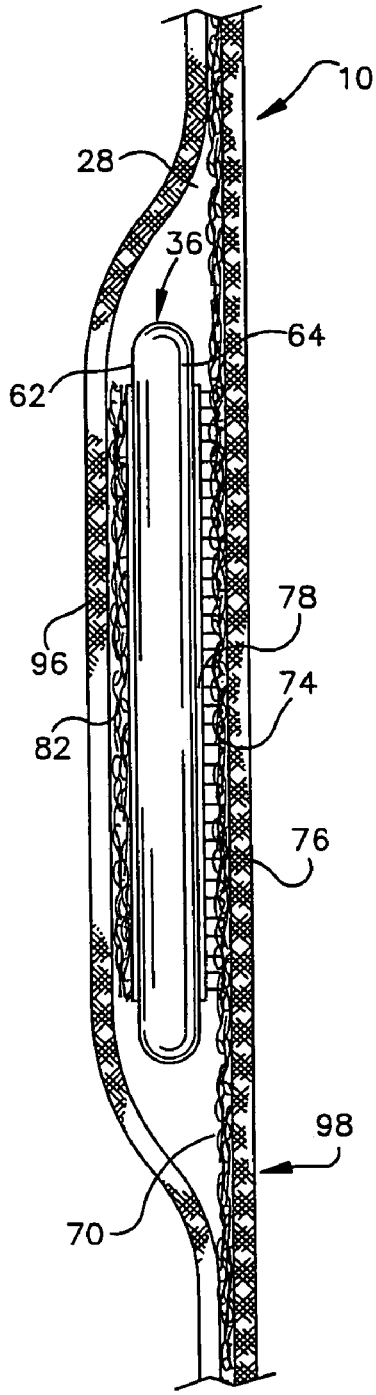
FIG. 5. is a fragmentary schematic sectional view, taken generally along the line 5—5 of FIG. 3, illustrating the manner in which the weight of FIG. 4 is connected with the bra of FIGS. 1–3 with the weight disposed in a pocket formed in the bra.

The weight 36 has generally rectangular front and rear major side surfaces 62 and 64 (FIG. 5). The front and rear side surfaces 62 and 64 of the generally rectangular weight 36 extend parallel to each other. The corners and minor side surfaces of the weight 36 are rounded (FIGS. 4 and 5) to minimize the possibility of discomfort to the woman 12 during the wearing of the sports bra 10.

Although the weights 36 may have many different magnitudes, in one specific embodiment, each of the weights 36 had a magnitude of approximately eight ounces. In this specific embodiment, each of the weights 36 was formed of metal encased by a layer of a suitable polymeric material. Each of the weights 36 had front and rear major side surfaces 62 and 64 with a height (as viewed in FIGS. 4 and 5) of approximately three inches and a width of approximately one and a half inches.

It should be understood that the foregoing specific dimensions and magnitudes of each of the weights 36 have been set forth herein for purposes of clarity of description and not for purposes of limiting the invention. It is contemplated that the weights 36 may have many other magnitudes and configurations. Rather than all being of the same magnitude, some of the weights 36 may be heavier than other weights.

The weight 36 is connected with the sports bra 10 by a releasable fastener system 70 (FIG. 5). The releasable fastener system 70 is effective to hold the weights against movement in the pockets 24–30 during movement of the woman 12 while she exercises. In the specific embodiment of the releasable fastener system 70 illustrated in FIG. 5, the fastener system is of the well known hook and loop type which is commercially available under the trademark VELCRO. Of course, other known releasable fastener systems may be utilized if desired. These fastener systems may be of the well known mechanical type. Alternatively, a recloseable fastener such as "dual lock" (trademark) may be used.

The specific releasable fastener system 70 illustrated in FIG. 5, includes a layer 74 of loop material which is secured to a rear panel 76 of the sports bra 10. A layer 78 of hook material is provided on the rear major side surface 64 of the weight 36. To connect the weight 36 with the sports bra 10, the layer 78 of the hook material and the layer 74 of the loop material are pressed against each other.

If desired the weights 36 may be utilized to cool the woman 12 during exercise. This may be accomplished by placing the weights 36 in a refrigerator or freezer before connecting them with the sports bra. The relatively cold weights 36 will absorb heat and cool the woman 10 as she exercises.

To further promote cooling, one or more cold packs may be substituted for one or more of the weights 36. The cold packs may have a rigid construction or a pliable construction. A fastener system having the same construction as the fastener system 70 may be utilized in association with the cold pack. Thus, a layer of hook material, corresponding to the layer 78 of FIG. 5, may be connected with cold pack. This layer of hook material would be pressed against the layer 74 of loop material secured to the sports bra 10 to fasten the cold pack to the sports bra.

The cold pack may be any one of many commercially available cold packs. The cold pack may have a construction similar to "blue ice" cold packs used in association with food packs. Alternatively, the cold pack may have any one of the constructions disclosed in or referred to in U.S. Pat. No. 5,650,090.

In accordance with one of the features of the present invention, the weight 36 may be positioned at any one of many different locations within in the pocket 28. Thus, the layer 78 of hook material on the rear major side surface 64 of the weight 36 may be pressed against the layer 74 of loop material at any desired location in the pocket 28. This enables the weight 36 to be positioned relatively close to the band 48 (as illustrated in FIG. 3). Alternatively, the weight 36 may be connected with the rear panel 76 at a location adjacent to the upper edge portion 56.

In accordance with another feature of the invention, a layer 82 of loop material is provided on the front major side surface 62 of the weight 36. This enables a second weight to be attached to the weight 36 of FIG. 5. Thus, a stack of two or more weights may be formed by positioning the layer 78 of hook material on one of the weights 36 in engagement with the layer 82 of loop material on another one of the weights. In addition, the layer 82 of loop material provides a cushion on the front major side surface 62 of the weight to enhance the comfort of the woman 12 wearing the sports bra 10.

The front portion 14 of the illustrated sports bra 10 includes a pair of cup portions 86 and 88 which enclose and support the breasts of the woman 12. The band 48 securely grips the torso of the woman 12 to hold the cup portions 86 and 88 in place. The cup portions 86 and 88 are also held in place by the strap portions 18 and 20.

A zipper 92 closes a front opening in the sports bra 10. The presence of the zipper 92 facilitates the putting on and taking off of the sports bra 10.

The layer 74 (FIG. 5) of loop material extends from one side of the zipper 92 at the front portion 14 of the sports bra 10, across the rear portion 16 of the sports bra, to the front portion of the sports bra disposed adjacent to the opposite side of the zipper. By having a continuous layer of loop material 76 extend throughout the outer sides of the pockets 24, 26, 28 and 30, the weights 36 can be located at any desired position in the pockets 24–30. In addition, the smooth continuous layer of loop material 74 provides the sports bra with a smooth appearing exterior surface. This enables the woman 12 to wear the sports bra 10 with a plurality of weights 36 without having the weights visible to a casual viewer of the sports bra.

The illustrated layer 74 (FIG. 5) of loop material forms a continuous lining for the inner sides of the outer panels of the pockets 24–30. However, the layer 74 of loop material may be separated into segments or strips. It is believed that it may be desired to form the layer 74 of loop material as a plurality of segments if the pockets 24–30 are separated from each other by seams. When the layer 74 of loop material in segmented, either a single segment or a plurality of segments of the layer 74 of loop material may be provided in each of the pockets 24–30.

The inside of the sports bra 10 is lined with a smooth soft polymeric material which absorbs perspiration. In one specific instance, an inner lining 96 (FIG. 5) of the sports bra 10 was formed of a breathable material sold under the trademark COOLMAX. Of course, the inner lining 96 may be formed of other materials if desired. The inner lining 96 cooperates with the outer layer 98 of the sports bra 10 to form the pockets 24–30.

Inserts of spandex, that is, a manufactured fiber in which the fiber-forming substance is a long-chain synthetic polymer comprised of at least 85% of a segmented polyurethane, are provided in the outer layer 98 to impart elasticity to the sports bra 10. Of course, other known materials can be utilized to impart elasticity to the sports bra 10.

In the illustrated embodiment of the sports bra 10, the lining 96 (FIG. 5) extends along the entire inside of the outer layer 98. However, it is believed that it may be desired to have the shoulders 18 and 20 (FIG. 1) be formed without a COOLMAX (trademark) lining. This would result in the shoulders being formed by the material of the outer layer 98. If desired, the portion of the outer layer 98 forming the shoulders 18 and 20 may be formed of a material having a high degree of elasticity, such as spandex. Alternatively, material having a high degree of elasticity may be used to form the portion of the lining 906 which extends across the shoulders 18 and 20 of the sports bra 10.

In the illustrated embodiment of the sports bra 10, the releasable fastener system 70 has been a hook and loop type fastener. However, it is contemplated that other known releasable fasteners may be utilized. For example, mechanical snaps, hooks, and/or buttons may be utilized to connect the weights 36 with the sports bra 10. If a mechanical snap or hook type retainer is utilized to connect the weights 36 with the sports bra, a plurality of separate portions of the fasteners may be provided on the sports bra at locations where it is believed that the woman 12 will desire to position the weights 36.

CONCLUSION

In view of the foregoing description, it is apparent that the invention relates to a new and improved sports bra 10 which is to be worn by a woman during exercise, such as the playing of games, aerobic exercises, or jogging. The bra 10 includes a front portion 14 which is designed to provide support for the woman's breasts during exercise. The bra also includes a rear portion 16 which is designed to extend across the woman's back.

One or more pockets 24–30 may be formed in the front and/or rear portion of the bra. One or more weights 36 may be disposed in the pocket or pockets to provide resistance which must be overcome by the woman during exercise.

A releasable fastener 70 may be utilized to connect the weight or weights 36 with the bra 10. The fastener 70 may include a first portion 78 which is connected with the weight or weights 36 and a second portion 74 which is disposed in the pocket 24, 26, 28, and/or 30 in the bra 10. The first and second fastener portions 78 and 74 are engageable to connect a weight 36 in the pocket 24, 26, 28, and/or 30 with the bra 10. A weight or weights 36 may be connected with the bra 10 at any one of a plurality of locations in the pocket or pockets 24, 26, 28, and/or 30. Fastener portions 78 and 82 may be provided to connect the weights 36 with each other.

It should be understood that the present invention provides a plurality of different features. These features may be utilized together in the manner disclosed herein. Alternatively, the features may be utilized separately or in combination with features from the prior art. It should be understood that the invention is not to be limited to the specific embodiment of the invention described herein.

Having described the invention, the following is claimed:

1. A bra to be worn by a woman during exercise, said bra comprising:

a front portion which is designed to provide support for the woman's breasts.

a rear portion which is connected with the front portion and is designed to extend across a portion of the woman's back, said rear portion including at least one pocket, first and second strap portions which are connected with said front and rear portions and are designed to extend across the woman's shoulders, an exercise weight releasably attached within the pocket to provide resistance which must be overcome by the woman during exercise, and a releasable fastener which secures said exercise weight inside a pouch portion of the pocket, said releasable fastener including a first fastener portion connected to said exercise weight and a second fastener portion which is disposed in the pocket and is connected to said rear portion of said bra, said first and second fastener portions being engageable to connect said exercise weight to said rear portion of said bra with said exercise weight in the pocket, said first and second fastener portions being separable to disconnect said exercise weight from said rear portion of said bra.

2. A bra as set forth in claim 1 wherein said rear portion of said bra includes an outer panel which extends across a portion of the woman's back and an inner panel which extends along said outer panel and is disposed between said outer panel and the woman's back, said inner and outer panels cooperating to at least partially define the pocket.

3. A bra as set forth in claim 1 wherein said exercise weight has a first size and the pocket has second size which is larger than the first size to enable said exercise weight to be located at any one of a plurality of positions in the pocket, and said first fastener portion is engageable with said second fastener portion when said exercise weight is in any one of a plurality of locations in the pocket to connect said exercise weight to said rear portion of said bra at a selected one of the plurality of locations.

4. A bra as set forth in claim 1 wherein said rear portion of said bra includes an upper edge portion which extends between said first and second strap portions, a lower edge portion which extends between opposite edge portions of said front portion, and an opening which extends between said upper and lower edge portions and provides access to the pocket, the opening extends between a central portion of said upper edge portion and a central portion of said lower edge portion and the pocket extends in opposite directions from the opening.

5. A bra as set forth in claim 1 further including a second exercise weight disposed in a second pocket in said front portion of said bra.

6. A bra as set forth in claim 1 wherein said front portion of said bra includes an upper edge portion which extends between said first and second strap portions, a lower edge portion which extends between opposite edge portions of said front portion, a first side portion which extends between said upper and lower edge portions and which overlies and is designed to provide support for a first one of the woman's breasts, a second side portion which extends between said upper and lower edge portions and which overlies and is designed to provide support for a second one of the woman's breasts, a second pocket disposed in the first side portion, a third pocket disposed in the second side portion, and a second exercise weight disposed in said second pocket, and a third exercise weight disposed in said third pocket.

7. A bra as set forth in claim 6 further including a closure device interconnecting the first and second side portions to facilitate putting on and taking off of the bra.

8. A bra as set forth in claim 6 further including a first releasable fastener which secures said second exercise weight inside the second pocket, said first releasable fastener including a first-fastener portion connected to said second exercise weight and a second fastener portion which is disposed inside the second pocket and is connected to said first side portion, and a second releasable fastener which secures said third exercise weight inside said third pocket, said second releasable fastener including a third fastener portion connected to said exercise weight and a fourth fastener portion which is disposed inside the third pocket and is connected to said second side portion, said first and second fastener portions being engageable to connect said second exercise weight to said first side portion of said bra with said second exercise weight in the second pocket, said first and second fastener portions being separable to disconnect said second exercise weight from said first side portion of said bra, said third and fourth fastener portions being engageable to connect said third exercise weight to said second side portion of said bra with said third exercise weight in the third pocket, said third and fourth fastener portions being separable to disconnect said third exercise weight from said second side portion of said bra.

9. A bra as set forth in claim 1 further including a second exercise weight disposed in said pocket, said exercise weights being interconnected by a releasable fastener, said releasable fastener including a first fastener portion connected to one of said exercise weights and a second fastener portion connected to another of said exercise weights, said first and second fastener portions being engageable to interconnect said exercise weights, said first and second fastener portions being separable to disconnect said exercise weights.

10. A bra as set forth in claim 1 further including a band which is designed to firmly grip the woman's torso and a pair of cup portions which are designed to at least partially enclose the woman's breasts, said cup portions being disposed between said band and said straps.

11. A bra as set forth in claim 1 further including a cold pack disposed in the pocket.

12. A bra as set forth in claim 1, further including a cold pack, a first releasable fastener which secures said weight inside the pocket, and a second releasable fastener which secures said cold pack inside the pocket, said first releasable fastener includes a first fastener portion connected to said weight and a second fastener portion which is disposed in the pocket and is connected to said rear portion of said bra, said first and second fastener portions being engageable to connect said weight to said rear portion of said bra, said first and second fastener portions being separable to disconnect said weight from said rear portion of said bra, said second releasable fastener including a third fastener portion connected to said cold pack and a fourth fastener portion which is disposed in the pocket and is connected to said rear portion of said bra, said third and fourth fastener portions being engageable to connect said cold pack to said rear portion of said bra, said third and fourth fastener portions being separable to disconnect said cold pack from said rear portion of said bra.

13. A bra to be worn by a woman during exercise, said bra comprising:

a front portion which is designed to provide support for a woman's breasts, a rear portion which is connected with the front portion and is designed to extend across a portion of the woman's back, at least one of said front and rear portions including at least a portion of at least one pocket, first and second strap portions which are connected with said front and rear portions and are designed to extend across the woman's shoulders, an exercise weight disposed in the pocket to provide resistance which must be overcome by the woman during exercise, and a releasable fastener which secures said exercise weight inside a pouch portion of the pocket, said releasable fastener including a first fastener portion connected to said exercise weight and a second fastener portion disposed in the pocket and connected to at least one of said front and rear portions of said bra, said first and second fastener portions being engageable to connect said exercise weight to said bra with said exercise weight in the pocket, said first and second fastener portions being separable to disconnect said exercise weight from said bra.

14. A bra as set forth in claim 13 wherein said rear portion of said bra includes at least a portion of the pocket.

15. A bra as set forth in claim 13 wherein said front portion of said bra includes at least a portion of the pocket.

16. A bra as set forth in claim 13 wherein said rear portion of said bra includes an outer panel which extends across a portion of the woman's back and an inner panel which extends along the outer panel and is disposed between said outer panel and the woman's back, said inner and outer panels cooperating to at least partially define the pocket.

17. A bra as set forth in claim 13 wherein said front portion of said bra includes an outer panel which extends across at least a portion of the woman's breasts and an inner panel which extends along the outer panel and is disposed between said outer panel and at least a portion of the woman's breasts, said inner and outer panels cooperating to at least partially define the pocket.

18. A bra as set forth in claim 13 wherein said exercise weight has a first size and the pocket has a second size which is larger than the first size to enable said exercise weight to be located at any one of a plurality of positions in the pocket, said first fastener portion being engageable with said second fastener portion when said exercise weight is in any one of a plurality of locations in the pocket to connect said exercise weight to said bra at a selected one of the plurality of locations.

19. A bra to be worn by a woman during exercise, said bra comprising:

a front portion which is designed to provide support for a woman's breasts, a rear portion which is connected with the front portion and is designed to extend across the woman's back, at least one of said front and rear portions including at least a portion of at least one pocket, first and second strap portions which are connected with said front and rear portions and are designed to extend across the woman's shoulders, a plurality of exercise weights which are disposed in a pouch portion of the pocket to provide resistance which must be overcome by the woman during exercise, a plurality of first fastener portions each of which is connected to one of said exercise weights of said plurality of exercise weights, a second fastener portion disposed in the pocket and connected to said bra, said first and second fastener portions being engageable to connect said plurality of exercise weights to said bra with said plurality of exercise weights in the pocket, said first and second fastener portions being separable to disconnect said plurality of exercise weights from said bra.

20. A bra as set forth in claim 19 wherein said second fastener portion includes a plurality of sections which are connected to said bra, each of said exercise weights of said plurality of exercise weights being connectable with any one of said sections of said second fastener portion.

21. A bra as set forth in claim 19 wherein said second fastener portion includes a section which is connected to said bra, each of said exercise weights of said plurality of exercise weights being connectable with said section of said fastener portion.

22. A bra as set forth in claim 19 wherein said rear portion of said bra includes at least a portion of the pocket.

23. A bra as set forth in claim 19 wherein said front portion of said bra includes at least a portion of the pocket.

24. A bra as set forth in claim 19 wherein each fastener portion of said plurality of first fastener portions is connectable with said second fastener portion at a plurality of different locations to enable each of said exercise weights to be positioned at a selected one of the plurality of different locations.

25. A bra as set forth in claim 19 further including a third fastener portion connected to a first one of said exercise weights of said plurality of exercise weights, said first fastener portion connected to a second one of said exercise weights of said plurality of exercise weights being engageable with said third fastener portion connected to said first one of said exercise weights to interconnect said first and second exercise weights.

* * * * *